US009244369B2

(12) United States Patent
Tanaka et al.

(10) Patent No.: US 9,244,369 B2
(45) Date of Patent: Jan. 26, 2016

(54) ELECTROPHOTOGRAPHIC PHOTOSENSITIVE MEMBER, PRODUCTION METHOD FOR ELECTROPHOTOGRAPHIC PHOTOSENSITIVE MEMBER, PROCESS CARTRIDGE AND ELECTROPHOTOGRAPHIC APPARATUS, AND PARTICLE HAVING COMPOUND ADSORBED THERETO

(71) Applicant: CANON KABUSHIKI KAISHA, Toyko (JP)

(72) Inventors: Masato Tanaka, Tagata-gun (JP); Masaki Nonaka, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 164 days.

(21) Appl. No.: 14/043,530

(22) Filed: Oct. 1, 2013

(65) Prior Publication Data

US 2014/0106269 A1 Apr. 17, 2014

(30) Foreign Application Priority Data

Oct. 12, 2012 (JP) ..... 2012-227217
Sep. 11, 2013 (JP) ..... 2013-188430

(51) Int. Cl.
*G03G 5/14* (2006.01)
*G03G 5/147* (2006.01)
*G03G 5/05* (2006.01)

(52) U.S. Cl.
CPC ..... *G03G 5/14708* (2013.01); *G03G 5/0507* (2013.01); *G03G 5/0525* (2013.01); *G03G 5/14704* (2013.01); *Y10T 428/2982* (2015.01)

(58) Field of Classification Search
CPC ..... G03G 5/14704; G03G 5/14708; G03G 5/0507; G03G 5/0525
USPC ..... 430/66, 67, 58.1, 58.35
See application file for complete search history.

(56) References Cited

U.S. PATENT DOCUMENTS

| | | | | |
|---|---|---|---|---|
| 5,194,353 | A | 3/1993 | Tanaka et al. | |
| 5,246,807 | A | 9/1993 | Kanemaru et al. | |
| 5,453,342 | A | 9/1995 | Go et al. | |
| 5,527,653 | A | 6/1996 | Tanaka | |
| 5,629,116 | A | 5/1997 | Kashizaki et al. | |
| 5,818,489 | A | 10/1998 | Yoshinaga et al. | |
| 6,040,100 | A | 3/2000 | Tanaka et al. | |
| 6,139,997 | A | 10/2000 | Tanaka et al. | |
| 6,180,303 | B1 | 1/2001 | Uematsu et al. | |
| 6,183,922 | B1 | 2/2001 | Takai et al. | |
| 6,190,811 | B1 | 2/2001 | Tanaka et al. | |
| 6,218,063 | B1 | 4/2001 | Tanaka et al. | |
| 6,248,490 | B1 | 6/2001 | Suzuki et al. | |
| 6,270,936 | B1 | 8/2001 | Tanaka et al. | |
| 6,300,027 | B1 | 10/2001 | Chambers et al. | |
| 6,335,132 | B1 | 1/2002 | Tanaka et al. | |
| 6,416,915 | B1 | 7/2002 | Kikuchi et al. | |
| 6,773,856 | B2 | 8/2004 | Tanaka et al. | |
| 7,276,318 | B2 | 10/2007 | Fujii et al. | |
| 7,517,626 | B2 | 4/2009 | Fujii et al. | |
| 7,695,880 | B2 * | 4/2010 | Yoshimura | 430/108.2 |
| 8,617,777 | B2 | 12/2013 | Tanaka | |
| 2007/0212626 | A1 | 9/2007 | Toshine et al. | |
| 2008/0292980 | A1 | 11/2008 | Fujita et al. | |
| 2010/0331431 | A1 | 12/2010 | Keiser et al. | |
| 2013/0137023 | A1 | 5/2013 | Watariguchi et al. | |
| 2013/0137025 | A1 | 5/2013 | Kawahara et al. | |
| 2014/0141362 | A1 | 5/2014 | Watariguchi et al. | |

FOREIGN PATENT DOCUMENTS

| | | | |
|---|---|---|---|
| JP | 2000-66425 | A | 3/2000 |
| JP | 2000-206715 | A | 7/2000 |
| JP | 2000-206716 | A | 7/2000 |
| JP | 2007-279678 | A | 10/2007 |
| JP | 2010-139618 | A | 6/2010 |
| JP | 2011-118046 | A | 6/2011 |
| WO | 2011/008484 | A2 | 1/2011 |

OTHER PUBLICATIONS

Diamond, A.S., ed., Handbook of Imaging Materials, Marcel Dekker, Inc., NY (1991), pp. 395-396.*
Tanaka, et al., U.S. Appl. No. 14/101,289, filed Dec. 9, 2013.
Tanaka, et al., U.S. Appl. No. 14/089,717, filed Nov. 25, 2013.
Barrett, et al., "The Determination of Pore Volume and Area Distributions in Porous Substances. I. Computations from Nitrogen Isotherms", Journal of American Chemical Society, vol. 73, 1951, pp. 373-380.
Brunauer, et al., "Adsorption of Gases in Multimolecular Layers", The Journal of American Chemical Society, vol. 60, 1938, pp. 309-319.
European Search Report dated Jan. 23, 2014 in European Application No. 13004793.9.
European Office Action dated Jul. 13, 2015 in European Application No. 13 004 793.9.

* cited by examiner

*Primary Examiner* — Janis L Dote
(74) *Attorney, Agent, or Firm* — Fitzpatrick, Cella, Harper and Scinto

(57) ABSTRACT

Provided is an electrophotographic photosensitive member including a surface layer containing particles which include: silica particles; and a compound-A adsorbed to each of the silica particles, in which the silica particles have a volume average particle diameter of 0.1 μm or more and 4 μm or less, and a specific surface area of 400 $m^2/g$ or more and 1000 $m^2/g$ or less, the compound-A is a tertiary amine compound and/or a urea compound, and the compound-A has a molecular weight of 150 or more and 550 or less.

15 Claims, 2 Drawing Sheets

ELECTROPHOTOGRAPHIC PHOTOSENSITIVE MEMBER, PRODUCTION METHOD FOR ELECTROPHOTOGRAPHIC PHOTOSENSITIVE MEMBER, PROCESS CARTRIDGE AND ELECTROPHOTOGRAPHIC APPARATUS, AND PARTICLE HAVING COMPOUND ADSORBED THERETO

BACKGROUND OF THE INVENTION

1. Field of the Invention

The present invention relates to an electrophotographic photosensitive member and a production method for an electrophotographic photosensitive member. The present invention also relates to a process cartridge and an electrophotographic apparatus. The present invention also relates to a particle having a compound adsorbed thereto.

2. Description of the Related Art

As an electrophotographic photosensitive member to be mounted on an electrophotographic apparatus, there is known an electrophotographic photosensitive member containing an organic photoconductive substance (charge generating substance), which has heretofore been studied extensively. In particular, in order to extend the lifetime of the electrophotographic photosensitive member and enhance image quality, an attempt has been made to improve the durability of the electrophotographic photosensitive member.

As a method of extending the lifetime of the electrophotographic photosensitive member, there has been proposed, for example, a method involving reinforcing a resin to be used in a charge transporting layer and introducing a curable protective layer. However, there is a problem in that image deletion occurs as the wear resistance of the layer is enhanced. The image deletion is a phenomenon in which an output image gets blurred owing to blurring of an electrostatic latent image. This phenomenon is considered to be caused by the following: a discharge product generated by charging remains on the surface of the electrophotographic photosensitive member to change properties of the constituent material for the surface of the photoelectric photosensitive member.

As a process for suppressing the image deletion, there is given a method involving incorporating an antioxidant or a basic compound into the electrophotographic photosensitive member. Japanese Patent Application Laid-Open No. 2007-279678 proposes a method involving suppressing the image deletion by incorporating a particular amine compound into a surface layer of the electrophotographic photosensitive member containing a curable resin. In addition, Japanese Patent Application Laid-Open No. 2011-118046 proposes a production method involving allowing hollow particles to support a substance effective for suppressing the image deletion. Further, Japanese Patent Application Laid-Open No. 2010-139618 proposes a protective layer containing metal oxide particles and an acid scavenger to improve the mechanical durability and the suppression of the image deletion.

However, as a result of a study by the inventors of the present invention, it was found that when a tertiary amine compound or an antioxidant is added as described in Japanese Patent Application Laid-Open Nos. 2007-279678 and 2010-139618, the potential stability and the effect of suppressing image deletion are not sufficient, and curing does not proceed sufficiently in some cases, with the result that the mechanical durability is liable to decrease. It was also found that the electrophotographic photosensitive member described in Japanese Patent Application Laid-Open No. 2011-118046 does not contain a substance effective for suppressing image deletion on the surfaces of hollow particles, and hence the effect of suppressing image deletion is not sufficient in some cases although the potential stability and curing are less affected.

SUMMARY OF THE INVENTION

In view of the foregoing, the present invention is directed to providing an electrophotographic photosensitive member which is excellent in mechanical durability and potential stability, and is capable of suppressing image deletion, and a production method for the electrophotographic photosensitive member. Further, the present invention is directed to providing a process cartridge and an electrophotographic apparatus each having the electrophotographic photosensitive member. Still further, the present invention is directed to providing a particle having a compound adsorbed thereto.

According to one aspect of the present invention, there is provided an electrophotographic photosensitive member including: a support; and a photosensitive layer formed on the support; in which a surface layer of the electrophotographic photosensitive member includes particles which include: silica particles; and a compound-A adsorbed to each of the silica particles, the silica particles have a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound and a urea compound, and the compound-A has a molecular weight of 150 or more and 550 or less.

According to another aspect of the present invention, there is provided a process cartridge detachably mountable to a main body of an electrophotographic apparatus, in which the process cartridge integrally supports: the above-described electrophotographic photosensitive member; and at least one device selected from the group consisting of a charging device, a developing device, a transferring device, and a cleaning device.

According to further aspect of the present invention, there is provided an electrophotographic apparatus, including: the above-described electrophotographic photosensitive member; a charging device; an image exposing device; a developing device; and a transferring device.

According to still another aspect of the present invention, there is provided a particle including: a silica particle; and a compound-A adsorbed to the silica particle, in which the silica particle has a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound and a urea compound, and the compound-A has a molecular weight of 150 or more and 550 or less.

According to still further aspect of the present invention, there is provided a production method for an electrophotographic photosensitive member including a support and a photosensitive layer formed on the support, the production method including: obtaining particles which include silica particles and a compound-A adsorbed to each of the silica particles by mixing the silica particles and the compound-A in a solvent followed by milling; preparing a surface-layer coating liquid containing the particles which include the silica particles and the compound-A adsorbed to each of the silica particles; forming a coat of the surface-layer coating liquid; and forming a surface layer by drying the coat, in which the silica particles have a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound and a urea compound, and the compound-A has a molecular weight of 150 or more and 550 or less.

According to the present invention, the high-performance electrophotographic photosensitive member, which satisfies mechanical durability, electrical durability, and suppression of image deletion at high levels even when used in a high output speed copier or printer for a long period of time, and the production method for the electrophotographic photosensitive member can be provided through the use of the above-mentioned particles in the surface layer of the electrophotographic photosensitive member. Further, according to the present invention, there are provided the process cartridge and the electrophotographic apparatus each having the electrophotographic photosensitive member. Still further, according to the present invention, provided is the high-functional particle that can enhance mechanical durability and suppress image deletion.

Further features of the present invention will become apparent from the following description of exemplary embodiments with reference to the attached drawings.

DESCRIPTION OF THE EMBODIMENTS

Figure 1A:
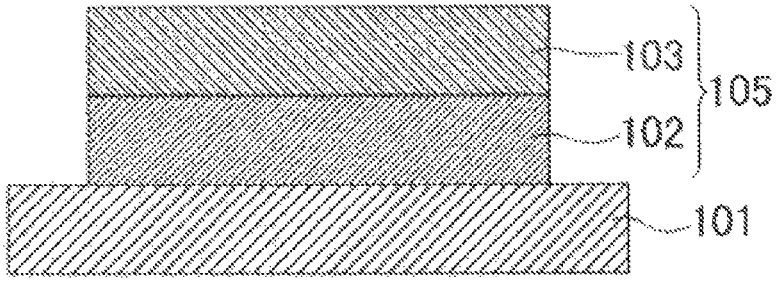
FIGS. 1A and 1B are views each illustrating an example of a layer configuration of an electrophotographic photosensitive member according to the present invention.

The present invention is described in detail below.

In an electrophotographic photosensitive member including a support and a photosensitive layer formed on the support, a surface layer of the electrophotographic photosensitive member includes particles including: silica particles and a compound-A adsorbed to each of the silica particles. The silica particles have a volume average particle diameter of from 0.1 μm to 4 μm, and a specific surface area of from 400 $m^2/g$ to 1000 $m^2/g$. The compound-A has a molecular weight of from 150 to 550, and is at least one selected from the group consisting of a tertiary amine compound and a urea compound.

The inventors of the present invention describe hereinafter the reasons why the electrophotographic photosensitive member of the present invention can enhance mechanical durability and potential stability, and suppress image deletion.

It has been reported that image deletion can be suppressed by incorporating an antioxidant and a basic compound into a surface layer of an electrophotographic photosensitive member. However, when an antioxidant and a basic compound are simply incorporated into the surface layer, the potential stability and mechanical durability of the electrophotographic photosensitive member are degraded in most cases. There is a procedure for combining the antioxidant and the basic compound with a curable resin in order to enhance the mechanical durability of the electrophotographic photosensitive member. According to the procedure, the antioxidant and the basic compound suppress a curing reaction, with the result that the mechanical durability of the electrophotographic photosensitive member may be liable to be degraded.

In view of the foregoing, the inventors of the present invention have used particles including: porous silica particles having a number of pores with a volume average particle diameter in the above-mentioned range and a specific surface area in the above-mentioned range; and a compound-A adsorbed to each of the silica particles, the compound-A having a high effect of suppressing image deletion and strong adsorbability to each of the silica particles. The inventors of the present invention have found that the effect of suppressing image deletion is expressed when the particles including the silica particles and the compound-A adsorbed to each of the silica particles are incorporated into the surface layer. The inventors of the present invention have considered that, as another effect, the mechanical durability of the electrophotographic photosensitive member can be enhanced without impairing the potential stability by using the particles including the silica particles and the compound-A adsorbed to each of the silica particles (hereinafter sometimes referred to as "adsorbed particles").

It is more preferred that the silica particles have a specific surface area of from 550 $m^2/g$ to 1000 $m^2/g$. It is still more preferred that the silica particles have a volume average particle diameter of from 3 μm to 4 μm and a specific surface area of from 500 $m^2/g$ to 760 $m^2/g$. The reason why it is more preferred that the silica particles have a specific surface area of from 550 $m^2/g$ to 1000 $m^2/g$ lies in the following: in the adsorbed particles, the contact area of the silica particles with respect to the compound-A contained in the surface layer of the electrophotographic photosensitive member is increased, and the effect of suppressing image deletion is enhanced.

Further, it is preferred that the silica particles have pores and an average pore diameter of 5 nm or less because the amount of the compound-A which is adsorbed to the silica particles increases, and it is more preferred that the silica particles have an average pore diameter of from 1 nm to 5 nm. Of those, silica particles having an average pore diameter of from 3 nm to 6 nm are preferred, and silica particles having an average pore diameter of from 3 nm to 5 nm are more preferred.

The compound-A is at least one selected from the group consisting of a tertiary amine compound and a urea compound, and has a molecular weight of from 150 to 550. More preferably, the compound-A has a molecular weight of from 240 to 448.

Of the tertiary amine compound having a molecular weight of from 150 to 550, a compound represented by the following structural formula (1) is more preferred because of a less reduction in potential stability and a high effect of suppressing image deletion.

Structural Formula (1)

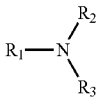

In the structural formula (1), $R_1$ to $R_3$ each independently represent a substituted or an unsubstituted alkyl group, a substituted or an unsubstituted aryl group, or a monovalent group represented by the following structural formula (2) or (3).

Structural Formula (2)

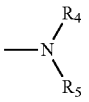

-continued

Structural Formula (3)

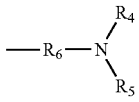

In the structural formulae (2) and (3), $R_4$ and $R_5$ each independently represent a substituted or an unsubstituted alkyl group or a substituted or an unsubstituted aryl group. $R_6$ represents a substituted or an unsubstituted alkylene group, a substituted or an unsubstituted arylene group, or a divalent group produced by combining the substituted or the unsubstituted alkylene group and the substituted or the unsubstituted arylene group.

Further, of the urea compound having a molecular weight of from 150 to 550, a compound represented by the following structural formula (4) is more preferred.

Structural Formula (4)

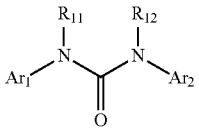

In the structural formula (4), $R_{11}$ and $R_{12}$ each independently represent an alkyl group. $Ar_1$ and $Ar_2$ each independently represent a substituted or an unsubstituted aryl group.

Further, of the urea compound having a molecular weight of from 150 to 550, a compound represented by the following structural formula (5) is more preferred.

Structural Formula (5)

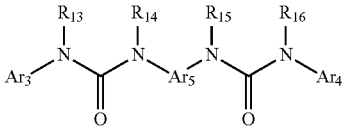

In the structural formula (5), $R_{13}$ to $R_{16}$ each independently represent an alkyl group. $Ar_3$ and $Ar_4$ each independently represent a substituted or an unsubstituted aryl group. $Ar_5$ represents a substituted or an unsubstituted arylene group.

In addition, in the structural formula (5), it is more preferred that $Ar_3$ and $Ar_4$ each represent a substituted or an unsubstituted phenyl group, $Ar_5$ represents a phenylene group, and $R_{13}$ to $R_{16}$ each represent a methyl group.

Further, it is preferred that the adsorption amount of the compound-A is from 10% by mass to 50% by mass (from 10 parts by mass to 50 parts by mass) with respect to 100 parts by mass of the particles including the silica particles and the compound-A adsorbed to each of the silica particles from the viewpoint of satisfying both the mechanical strength and the suppression of image deletion. The adsorption amount is more preferably from 11% by mass to 40% by mass (from 11 parts by mass to 40 parts by mass).

Examples of the alkyl group in the structural formulae (1) to (5) include a methyl group, an ethyl group, and an n-propyl group. Examples of the alkyl group having a substituent include: alkoxy-substituted alkyl groups such as a methoxymethyl group and an ethoxymethyl group; halogen-substituted alkyl groups such as a trifluoromethyl group and a trichloromethyl group; and aryl-substituted alkyl groups such as a benzyl group, a phenethyl group, and a p-methylbenzyl group.

Examples of the aryl group in the structural formulae (1) to (5) include a phenyl group, a biphenylyl group, a fluorenyl group, and a naphthylene group. Examples of the aryl group having a substituent include: alkyl-substituted aryl groups such as a tolyl group and a xylyl group; alkoxy-substituted aryl groups such as a methoxyphenyl group and an ethoxyphenyl group; alkylamino-substituted aryl groups such as a dimethylaminophenyl group, a methylaminophenyl group, and a diethylaminophenyl group; and halogen-substituted aryl groups such as a chlorophenyl group and a bromophenyl group.

Examples of the arylene group in the structural formulae (3) and (5) include a phenylene group, a biphenylene group, a naphthylene group, and a phenanthrene group. Example of the arylene group having a substituent include: alkyl-substituted arylene groups such as a methylphenylene group; and halogen-substituted arylene groups such as a chlorophenylene group.

Specific examples (exemplified compounds) of a tertiary amine compound and urea compound having a molecular weight of from 150 to 550 used preferably in the present invention are described below. However, the present invention is not limited to those examples.

Exemplified compound (1-1)

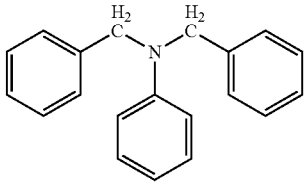

Exemplified Compound (1-2)

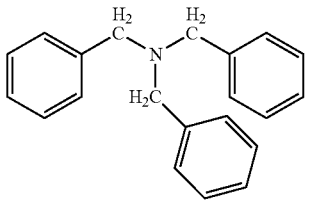

Exemplified Comound (1-3)

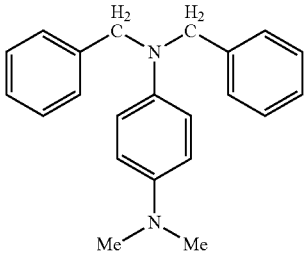

Exemplified Compound (1-4)

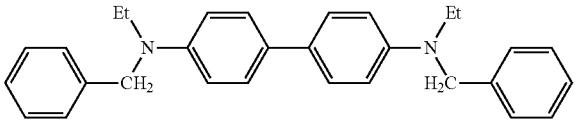

-continued

Exemplified Compound (1-5)

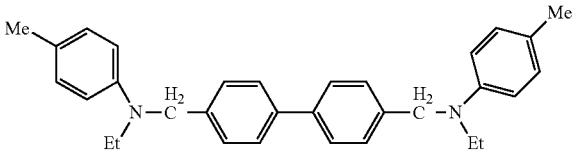

Exemplified Compound (1-6)

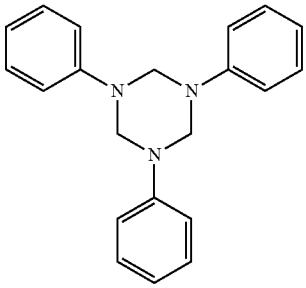

Exemplified Compound (1-7)

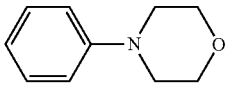

Exemplified Compound (2-1)

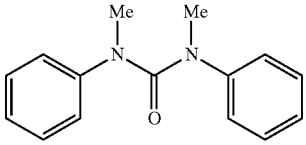

Exemplified Compound (2-2)

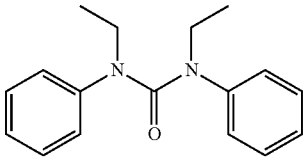

Exemplified Compound (2-3)

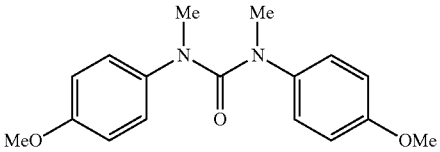

Exemplified Compound (2-4)

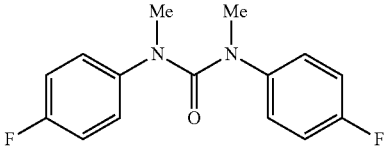

Exemplified Compound (2-5)

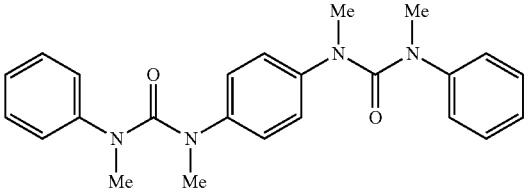

-continued

Exemplified Compound (2-6)

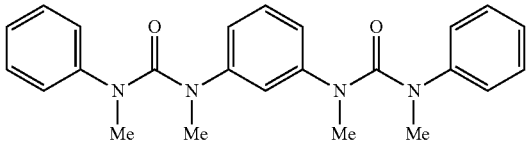

Exemplified Compound (2-7)

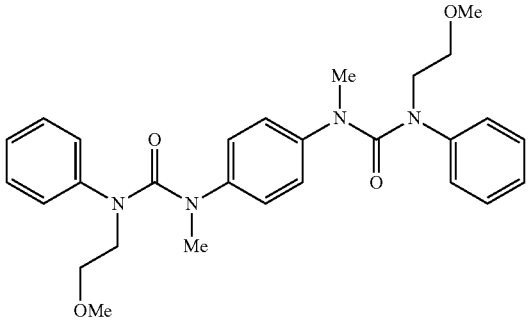

Exemplified Compound (2-8)

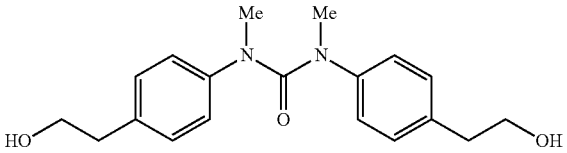

Exemplified Compound (2-9)

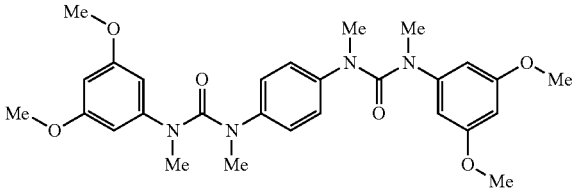

Exemplified Compound (2-10)

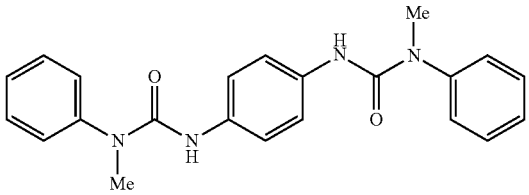

Exemplified Compound (2-11)

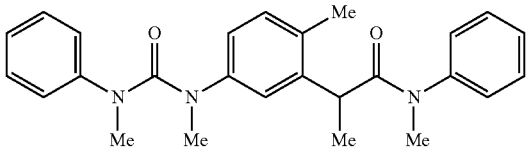

Exemplified Compound (2-12)

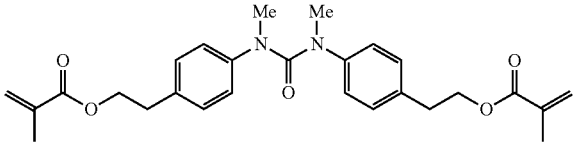

In the above-mentioned exemplified compounds, Me represents a methyl group, and Et represents an ethyl group.

Of the above-mentioned compounds, Exemplified Compounds (1-1) to (1-5) as tertiary amine compounds and Exemplified Compounds (2-1) to (2-9) as urea compounds are more preferred because the effects of the present invention are sufficiently obtained. In particular, Exemplified Compounds (2-5) and (2-6) are preferred.

Further, the particles including the silica particles and the compound-A adsorbed to each of the silica particles refer to particles including porous silica particles and the compound-A chemically (chemical adsorption) or physically (physical adsorption) adsorbed to each of the porous silica particles.

The volume average particle diameter of the silica particles was measured as follows. First, silica particles were dispersed in ion-exchange water so that the concentration of the silica particles reached 3% by mass. The resultant was treated with an ultrasonic disperser for about 5 minutes to prepare a measurement liquid, and the volume-based average diameter of the silica particles was measured through the use of a light scattering diffraction type particle size distribution measuring apparatus (COULTER LS-230, manufactured by Coulter Inc.). The measured value was defined as a volume average particle diameter. Note that, for measurement, the refractive index of water serving as a dispersion medium was set to 1.332, and the refractive index of silica was set to 1.458.

Further, the specific surface area of the silica particles refers to a specific surface area determined by nitrogen adsorption (so-called BET method) in accordance with ASTM Standard D3663-78 established from the BRUNAUER-EMMETT-TELLER method described in The Journal of American Chemical Society, 60, 309, (1938).

Further, the average pore diameter of the silica particles refers to a value indicating the peak of pore distribution (Barrett-Joyner-Halenda: BJH model) measured by nitrogen adsorption. The nitrogen adsorption-desorption isotherm based on the BJH model is described by E. P. Barrett, L. G. Joyner, and P. P. Halenda in The Journal of American Chemical Society, 73, 373, (1951).

Silica particles having a volume average particle diameter of from 0.1 μm to 4 μm and a specific surface area of from 400 $m^2/g$ to 1000 $m^2/g$ are exemplified below. However, the present invention is not limited thereto.

Product name: CARiACT G-3 (manufactured by FUJI SILYSIA CHEMICAL LTD., specific surface area: 600 $m^2/g$, average particle diameter: 3 μm, average pore diameter: 3 nm)

Product name: CARiACT G-6 (manufactured by FUJI SILYSIA CHEMICAL LTD., specific surface area: 500 $m^2/g$, average particle diameter: 3 μm, average pore diameter: 6 nm)

Product name: Sylysia 710 (manufactured by FUJI SILYSIA CHEMICAL LTD., specific surface area: 700 $m^2/g$, average particle diameter: 2.8 μm, average pore diameter: 2.5 nm)

Product name: Porous Silica (manufactured by Kusumoto Chemicals, Ltd., specific surface area: 760 $m^2/g$, average particle diameter: 4 μm, mesopore diameter: 7.1 nm, pore diameter: 1.7 nm)

Product name: Nanoporous Silica (manufactured by Sumitomo Osaka Cement Co., Ltd., specific surface area: 970 $m^2/g$, average particle diameter: 0.05 μm, average pore diameter: 3 nm).

Next, a production method for particles including the silica particles and the compound-A adsorbed to each of the silica particles is described.

The particles including the silica particles and the compound-A adsorbed to each of the silica particles are obtained by stirring or heating the compound-A together with silica particles having a volume average particle diameter of from 0.1 μm to 4 μm and a specific surface area of from 400 $m^2/g$ to 1000 $m^2/g$ in a solvent, and thereafter separating the solvent by filtration or the like, followed by drying. The solvent to be used and the ratio between the compound-A and the silica particles are selected considering the solubility of the compound-A.

In the present invention, it was determined whether or not the compound-A was adsorbed to the silica particles by subjecting the obtained particles to thermogravimetric (TG) measurement and analyzing the data.

For example, particles after being subjected to an adsorption treatment, silica particles before being subjected to the adsorption treatment, and the compound-A to be adsorbed to the silica particles are separately subjected to the TG measurement. Then, in the case where it can be interpreted that the TG measurement result obtained from the particles after being subjected to the adsorption treatment is merely a combination of measurement results of the silica particles before being subjected to the adsorption treatment and the compound-A to be adsorbed to the silica particles at a predetermined ratio, it can be determined that the particles are a mixture of the silica particles and the compound-A, or particles including the silica particles and the compound-A simply attaching to each surface of the silica particles.

On the other hand, in the case where the TG measurement result obtained from the particles after being subjected to the adsorption treatment exhibits a reduction in weight at temperatures higher than the sublimation temperature of the compound-A alone, it can be determined that the particles are particles including the silica particles and the compound-A adsorbed to each of the silica particles.

The TG measurement of the present invention is conducted under the following conditions.

(TG Measurement)

Measuring apparatus used: TG/DTA simultaneous measuring instrument (trade name: TG/DTA 220U) manufactured by Seiko Instruments Inc.

Atmosphere: under a nitrogen stream (300 $m^2$/min)

Measurement range: 35° C. to 600° C.

Temperature increase speed: 10° C./min

Figure 1B:
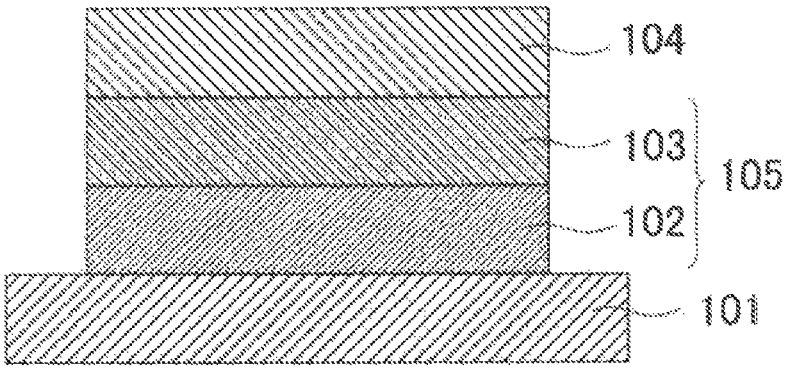

An electrophotographic photosensitive member includes a support and a photosensitive layer formed on the support (FIGS. 1A and 1B). As the photosensitive layer, there are given a single layer type photosensitive layer containing a charge generating substance and a charge transporting substance in the same layer, and a laminated (functional separation type) type photosensitive layer which is separated into a charge generating layer containing a charge generating substance and a charge transporting layer containing a charge transporting substance. In the electrophotographic photosensitive member, the laminated type photosensitive layer is preferred. Further, the charge transporting layer itself can have a laminated configuration. Further, a protective layer may be formed on the charge transporting layer.

A photosensitive layer 105 (charge generating layer 102, charge transporting layer 103) is formed on a support 101. A protective layer 104 may be provided on the charge transporting layer 103. As necessary, an intermediate layer (undercoat layer) may be provided between the support 101 and the charge generating layer 102.

A surface layer of the electrophotographic photosensitive member refers to a layer positioned on an outermost surface. For example, in the case of an electrophotographic photosensitive member having a layer configuration illustrated in FIG. 1A, the charge transporting layer 103 serves as the surface layer of the electrophotographic photosensitive member. Further, in the case of the electrophotographic photosensitive member having a layer configuration illustrated in FIG. 1B, the protective layer 104 serves as the surface layer of the electrophotographic photosensitive member.

In the electrophotographic photosensitive member, the surface layer can be formed by dispersing adsorbed particles in a binder resin, as necessary, dispersing adsorbed particles in a solution in which a charge transporting substance is added and dissolved, to thereby obtain a surface-layer coating liquid, applying the surface-layer coating liquid to form a coat, and drying the coat. Alternatively, the surface layer can also be formed by dispersing adsorbed particles in a solution in which a charge transporting substance having a chain polymerizable functional group is dissolved to obtain a surface-layer coating liquid, applying the surface-layer coating liquid to form a coat, and polymerizing the charge transporting substance having a chain polymerizable functional group. In the present invention, a surface layer containing the adsorbed particles and a polymer obtained by polymerizing a compound having two or more chain polymerizable functional groups in the same molecule is preferred from the viewpoint of mechanical durability.

It is preferred that the compound having two or more chain polymerizable functional groups in the same molecule be a charge transporting substance. Further, in the case where mechanical strength can be enhanced through the combined use of a polyfunctional monomer (compound having two or more chain polymerizable functional groups in the same molecule and having no charge transporting ability), a compound having only one chain polymerizable functional group can be used as the charge transporting substance.

A charge transporting substance having an aryl group or a heteroaryl group is generally used as the charge transporting substance (charge transporting compound). Examples thereof include an oxazole derivative, an oxadiazole derivative, an imidazole derivative, a triarylamine derivative, styrylanthracene, styrylpyrazoline, phenylhydrazones, a triazole derivative, a triazole derivative, a benzofuran derivative, a benzimidazole derivative, and an N-phenylcarbazole derivative.

The charge transporting substance having a chain polymerizable functional group is preferably a compound disclosed in Japanese Patent Application Laid-Open No. 2000-066425, Japanese Patent Application Laid-Open No. 2000-206715, or Japanese Patent Application Laid-Open No. 2000-206716, particularly preferably a compound represented by the following structural formula (6) from the viewpoints of mechanical durability and electrical stability.

Structural Formula (6)

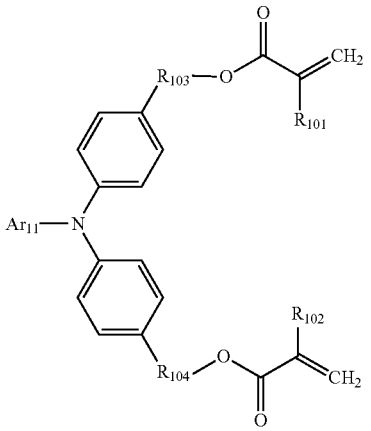

In the structural formula (6), $Ar_{11}$ represents an aryl group that may have an alkyl group and/or an alkoxy group. $R_{101}$ and $R_{102}$ each independently represent a hydrogen atom or a methyl group. $R_{103}$ and $R_{104}$ each independently represent an alkylene group having 1 to 4 carbon atoms. Examples of the aryl group include a phenyl group, a biphenylyl group, and a fluorenyl group. Examples of the alkyl group include a methyl group, an ethyl group, a propyl group, and a butyl group. Examples of the alkoxy group include a methoxy group and an ethoxy group.

Examples of the binder resin to be used in the surface layer include a polyvinyl butyral resin, a polyarylate resin, a polycarbonate resin, a polyester resin, a phenoxy resin, a polyvinyl acetate resin, an acrylic resin, a polyacrylamide resin, a polyamide resin, a polyvinyl pyridine, a cellulose-based resin, a urethane resin, an epoxy resin, an agarose resin, a cellulose resin, casein, a polyvinyl alcohol resin, and a polyvinyl pyrrolidone.

Examples of the charge transporting substance to be used in the surface layer include a triarylamine compound, a hydrazone compound, a stilbene compound, a pyrazoline compound, an oxazole compound, a thiazole compound, and a triarylmethane compound.

Examples of the solvent to be used in the surface-layer coating liquid include: alcohol-based solvents such as methanol, ethanol, and propanol; ketone-based solvents such as acetone, methyl ethyl ketone, and cyclohexanone; ester-based solvents such as ethyl acetate and butyl acetate; ether-based solvents such as tetrahydrofuran and dioxane; halogen-based solvents such as 1,1,2,2,3,3,4-heptafluorocyclopentane, dichloromethane, dichloroethane, and chlorobenzene; aromatic solvents such as benzene, toluene, and xylene; and cellosolve-based solvents such as methyl cellosolve and ethyl cellosolve. Those solvents may be used alone or in combination of two or more thereof.

Various additives can be added to the surface layer of the electrophotographic photosensitive member. Examples of the additives include polytetrafluoroethylene (PTFE) resin fine particles, lubricants such as fluorocarbon, and polymerization control agents such as a polymerization reaction initiator and a polymerization reaction terminator.

Next, the configuration of the electrophotographic photosensitive member is described.

(Support)

As a material for the support (conductive support) of the electrophotographic photosensitive member, there are given metals or alloys thereof, such as aluminum, stainless steel, and nickel. Further, as the support, there may be given an insulating support made of a polyester resin or a polycarbonate resin, on which a thin film made of a metal such as aluminum or copper or a thin film made of a conductive material such as indium oxide or tin oxide is formed. A resin impregnated with conductive particles such as carbon black, tin oxide particles, or titanium oxide particles, or plastic containing a conductive binder resin can also be used. As the shape of the support, there are given a cylindrical shape and a sheet shape. Of those, a cylindrical shape is preferred. Further, it is preferred that the surface of the support be appropriately roughened so as to suppress interference fringes. Specifically, it is preferred to use a support subjected to a cutting treatment, a roughening treatment, and an alumite treatment.

In the electrophotographic photosensitive member, the conductive layer may be provided between the support and the photosensitive layer or the undercoat layer. The conductive layer can be formed by applying a conductive-layer coating liquid containing conductive particles and a resin to the support to form a coat, and drying the coat. The conductive layer contains powder including the conductive particles.

Examples of the conductive particles include: powders of carbon black, acetylene black, metals such as aluminum, zinc, copper, chromium, nickel, and silver, and alloys thereof, and powders of metal oxides such as tin oxide and ITO. Further, a surface roughness providing material may be incorporated in order to suppress interference fringes.

Example of the resin to be used in the conductive layer include an acrylic resin, an alkyd resin, an epoxy resin, a phenol resin, a butyral resin, a polyacetal resin, a polyurethane, a polyester, a polycarbonate, and a melamine resin.

As a solvent to be used in the conductive-layer coating liquid, there are given an ether-based solvent, an alcohol-based solvent, a ketone-based solvent, and an aromatic hydrocarbon solvent. The thickness of the conductive layer is preferably from 0.2 μm to 40 μm, more preferably from 5 μm to 40 μm.

In the electrophotographic photosensitive member, an undercoat layer may be provided between the support or conductive layer and the photosensitive layer. The undercoat layer can be formed by applying an undercoat-layer coating liquid containing a resin onto the support or the conductive layer to form a coat, and drying or curing the coat.

Examples of the resin to be used in the undercoat layer include a polyvinyl alcohol resin, a poly-N-vinyl imidazole resin, a polyethylene oxide resin, ethyl cellulose, an ethylene-acrylic acid copolymer, casein, a polyamide resin, an N-methoxymethylated 6-nylon, a copolymerized nylon, glue, and gelatin. Further, the conductive particles may be incorporated in the undercoat layer.

As a solvent to be used in the undercoat-layer coating liquid, there are given an ether-based solvent, an alcohol-based solvent, a ketone-based solvent, and an aromatic hydrocarbon solvent. The thickness of the undercoat layer is preferably from 0.05 μm to 40 μm, more preferably from 0.4 μm to 20 μm. Further, the undercoat layer may contain semiconductive particles, an electron transporting substance, or an electron accepting substance.

(Photosensitive Layer)

The photosensitive layer (charge generating layer, charge transporting layer) is formed on the support, the conductive layer, or the undercoat layer.

Examples of the charge generating substance include a pyrylium-based dye and a thiapyrylium-based dye, a phthalocyanine compound, an anthanthrone pigment, a dibenzopyrenequinone pigment, a pyranthrone pigment, an azo pigment, an indigo pigment, a quinacridone pigment, and a quinocyanine pigment. Of those, gallium phthalocyanine is preferred. In addition, a hydroxygallium phthalocyanine crystal having strong peaks at Bragg angles (2θ±0.2°) of 7.4° and 28.2° in CuKα characteristic X-ray diffraction is more preferred from the viewpoint of high sensitivity.

Examples of the binder resin to be used for the charge generating layer in the laminated type photosensitive layer include: a polymer or copolymer of a vinyl compound such as styrene, vinyl acetate, or vinyl chloride; and a polyvinyl alcohol resin, a polyvinyl acetal resin, a polyvinyl benzal resin, a polycarbonate resin, a polyester resin, a polysulfone resin, a polyphenylene oxide, a polyurethane resin, a cellulose resin, a phenol resin, a melamine resin, a silicon resin, and an epoxy resin. One kind of those resins may be used alone, or two or more kinds thereof may be used as a mixture or a copolymer.

The charge generating layer can be formed by dispersing a charge generating substance together with a binder resin and a solvent to obtain a charge-generating-layer coating liquid, applying the charge-generating-layer coating liquid to form a coat, and drying the coat. Further, the charge generating layer may be used as a film of the charge generating substance deposited from the vapor.

In the charge generating layer, it is preferred that the ratio between the charge generating substance and the binder resin be from 0.2 part by mass to 2 parts by mass of the binder resin with respect to 1 part by mass of the charge generating substance. Further, as a dispersion method, there is given a method involving using a homogenizer, an ultrasonic wave, a ball mill, a sand mill, an attritor, or a roll mill.

Examples of the solvent to be used in the charge-generating-layer coating liquid include an alcohol-based solvent, a sulfoxide-based solvent, a ketone-based solvent, an ether-based solvent, an ester-based solvent, and an aromatic hydrocarbon solvent. The thickness of the charge generating layer is preferably from 0.01 μm to 5 μm, more preferably from 0.1 μm to 1 μm. Various sensitizers, antioxidants, UV absorbers, and plasticizers can also be added as necessary.

In the electrophotographic photosensitive member including the laminated type photosensitive layer, the charge transporting layer is formed on the charge generating layer. In the case where the charge transporting layer serves as the surface layer as illustrated in FIG. 1A, the charge transporting layer can be formed by dissolving a charge transporting substance and a binder resin in a solvent, dispersing adsorbed particles in the resultant solution to obtain a charge-transporting-layer coating liquid, forming a coat of the charge-transporting-layer coating liquid, and drying the coat. Alternatively, the charge transporting layer can be also obtained by dissolving a charge transporting substance having a chain polymerizable functional group in a solvent, dispersing adsorbed particles in the resultant solution to obtain a charge-transporting-layer coating liquid, forming a coat of the charge-transporting-layer coating liquid, and polymerizing the charge transporting substance having a chain polymerizable functional group. Note that, as illustrated in FIG. 1B, in the case where the protective layer is formed on the charge transporting layer and the protective layer serves as the surface layer, the charge transporting layer can be formed by forming a coat of a charge-transporting-layer coating liquid containing a charge transporting substance and a binder resin, and drying the coat.

As the charge transporting substance to be used in the charge transporting layer, there are given those which are similar to the charge transporting substance used in the surface layer.

As the charge transporting substance having a chain polymerizable functional group to be used in the charge transporting layer, there are given those which are similar to the charge transporting substance having a chain polymerizable functional group used in the surface layer. It is preferred that the amount of the charge transporting substance having a chain polymerizable functional group be from 20% by mass to 99% by mass with respect to the total solid content of the charge-transporting-layer coating liquid.

As the binder resin to be used in the charge transporting layer of the laminated type photosensitive layer, there are given those which are similar to the binder resin used in the surface layer.

It is preferred that the ratio of the charge transporting substance in the charge transporting layer be from 30% by mass to 70% by mass of the charge transporting substance with respect to the total mass of the charge transporting layer.

It is preferred that the ratio of the adsorbed particles in the charge transporting layer be from 2% by mass to 30% by mass of the adsorbed particles with respect to the total weight of the charge transporting layer.

Examples of the solvent to be used in the charge-transporting-layer coating liquid include an ether-based solvent, an alcohol-based solvent, a ketone-based solvent, and an aromatic hydrocarbon solvent. The thickness of the charge transporting layer is preferably from 5 μm to 40 μm.

In the present invention, the protective layer may be provided on the charge transporting layer. The protective layer can be formed by dissolving a binder resin and a charge transporting substance, as necessary, in a solvent, dispersing adsorbed particles in the resultant solution to obtain a protective-layer coating liquid, applying the protective-layer coating liquid to form a coat, and drying the coat. Alternatively, the protective layer can also be formed by dissolving a charge transporting substance having a chain polymerizable functional group in a solvent, dispersing adsorbed particles in the resultant solution to obtain a protective-layer coating liquid, applying the protective-layer coating liquid to form a coat, and polymerizing the charge transporting substance having a chain polymerizable functional group.

As the charge transporting substance to be used in the protective layer, there are given those which are similar to the charge transporting substance used in the surface layer. The ratio of the charge transporting substance is preferably from 30% by mass to 70% by mass of the charge transporting substance with respect to the total mass of the protective layer.

As the binder resin to be used in the protective layer, there are given those which are similar to the binder resin used in the surface layer.

As the charge transporting substance having a chain polymerizable functional group to be used in the protective layer, there are given those which are similar to the charge transporting substance having a chain polymerizable functional group used in the surface layer. The ratio of the charge transporting substance having a chain polymerizable functional group is preferably from 20% by mass to 99% by mass with respect to the total solid content of the protective-layer coating liquid.

The ratio of the adsorbed particles in the protective layer is preferably from 5% by mass to 30% by mass of the adsorbed particles with respect to the total weight of the protective layer.

The thickness of the protective layer is preferably from 2 μm to 10 μm.

An application method such as a dip coating method (dipping method), a spray coating method, a spinner coating method, a bead coating method, a blade coating method, or a beam coating method may be used in applying the coating liquid for each layer.

As a method of polymerizing the charge transporting substance having a chain polymerizable functional group in forming the surface layer, there may be given the following method. The method involves forming a coat of a surface-layer coating liquid containing adsorbed particles and a charge transporting substance having a chain polymerizable functional group, drying the coat, and polymerizing the charge transporting substance having a chain polymerizable functional group to form a surface layer.

The charge transporting substance having a chain polymerizable functional group can be polymerized through the use of heat, light (e.g., UV rays), or a radiation (e.g., electron beam). Of those, polymerization using a radiation, which is not necessarily required to use a polymerization initiator, is preferred, and polymerization using an electron beam is more preferred.

When the charge transporting substance is polymerized through the use of an electron beam, a three-dimensional network structure with a very high density is formed, and satisfactory potential stability is obtained. Further, the polymerization using an electron beam can be performed efficiently in a short period of time, and hence productivity thereof is also high. Further, when the charge transporting substance is polymerized through the use of an electron beam, the effect of polymerization inhibition at a time when the thickness of the charge transporting substance is large or when a shielding substance such as an additive is present in the charge transporting layer serving as the surface layer is small, because the polymerization using an electron beam enables electron beam transmittance to be controlled easily. Note that, there are cases where the polymerization reaction does not proceed smoothly depending on the kind of a chain polymerizable functional group or the kind of a central skeleton, and in this case, a polymerization initiator can also be added within a range having no effects. In the case where the charge transporting substance is irradiated with an electron beam, as an accelerator, any of the following types: a scanning type, an electrocurtain type, a broad beam type, a pulse type, and a laminar type can be used.

Preferred irradiation conditions for irradiating the charge transporting substance with an electron beam are as follows. An acceleration voltage is preferably 120 kV or less, more preferably 80 kV or less. Further, the absorbed dose of an electron beam is preferably $1\times10^3$ to $1\times10^5$ Gy, more preferably $5\times10^3$ to $5\times10^4$ Gy.

Further, in the case where the charge transporting substance having a chain polymerizable functional group is polymerized through the use of an electron beam, it is preferred to heat the charge transporting substance in an inert gas atmosphere after irradiating the charge transporting substance with an electron beam in an inert gas atmosphere in order to eliminate a polymerization inhibition due to oxygen. As the inert gas, there are given nitrogen, argon, and helium.

Figure 2:
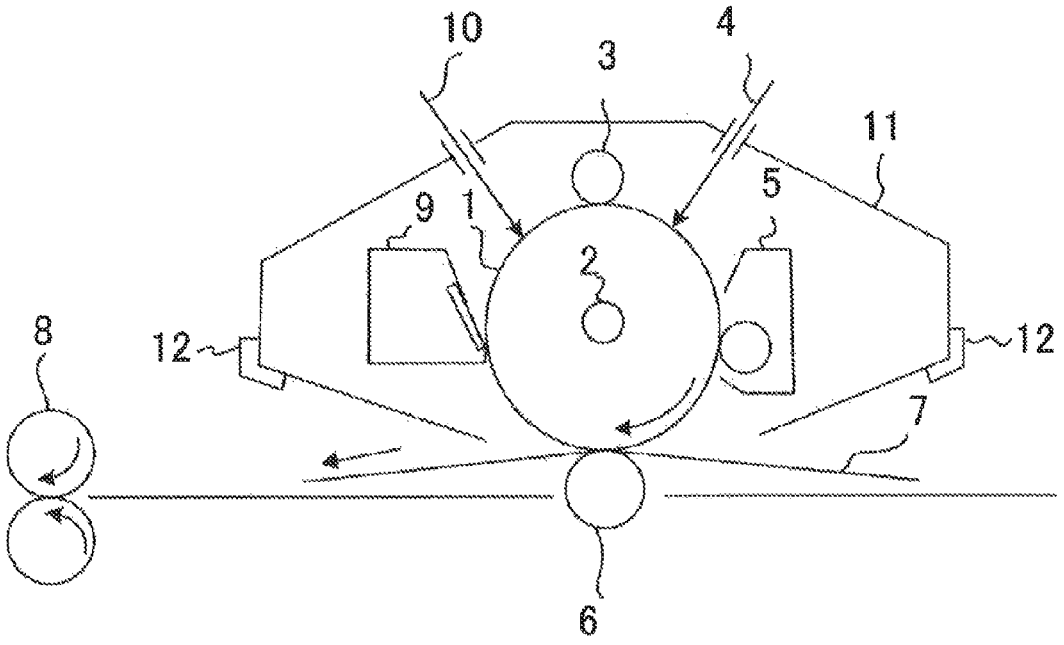
FIG. 2 is a view illustrating an example of a schematic configuration of an electrophotographic apparatus including a process cartridge having the electrophotographic photosensitive member according to the present invention.

FIG. 2 illustrates an example of a schematic configuration of an electrophotographic apparatus including a process cartridge having an electrophotographic photosensitive member.

In FIG. 2, an electrophotographic photosensitive member 1 is rotationally driven at a predetermined circumferential speed (process speed) in an arrow direction about an axis 2. During the rotation, the circumferential surface of the electrophotographic photosensitive member 1 is uniformly charged to a predetermined positive or negative potential by a charging device (primary charging device) 3. The charged surface of the electrophotographic photosensitive member 1 receives image exposure light 4 whose intensity has been modulated in accordance with a time-series electric digital image signal of intended image information output from an image exposing device (not shown) such as a slit exposing device or a laser beam scanning exposing device. Thus, an electrostatic latent image corresponding to the intended image information is successively formed on the surface of the electrophotographic photosensitive member 1.

The electrostatic latent image formed on the electrophotographic photosensitive member is then visualized as a toner image by normal development or reversal development with toner stored in a developing device 5. The toner image formed and carried on the surface of the electrophotographic photosensitive member 1 is successively transferred to a transfer material 7 by a transferring device 6. In this case, the transfer material 7 is taken out from a sheet feeding unit (not shown) in synchronization with the rotation of the electrophotographic photosensitive member 1 and fed to a gap between the electrophotographic photosensitive member 1 and the transferring device 6. Further, the transferring device 6 is supplied with a bias voltage having a polarity opposite to that of charge held by toner from a bias power supply (not shown). Further, the transferring device 6 may be an intermediate transfer type transferring device having a primary transferring member, an intermediate transferring member, and a secondary transferring member.

The transfer material 7 having a toner image transferred thereto is separated from the surface of the electrophotographic photosensitive member 1 and transported to a fixing device 8. Then, the toner image is fixed to the transfer material 7, and the transfer material 7 is printed out of the electrophotographic apparatus as an image-formed product (print, copy).

The surface of the electrophotographic photosensitive member 1 after the transfer of the toner image is cleaned by a cleaning device 9. In this case, matters attached to the surface of the electrophotographic photosensitive member, such as transfer residual toner remaining on the surface without being transferred, are removed by the cleaning device 9. The transfer residual toner can also be collected by the developing device 5. Further, as necessary, the surface of the electrophotographic photosensitive member after the transfer of the toner image is subjected to an antistatic treatment with pre-exposure light 10 from a pre-exposing device (not shown), and then repeatedly used in image formation. Note that, in the case where the charging device 3 is a contact charging device using a charging roller, the pre-exposing device is not necessarily required.

In the present invention, of the structural components such as the electrophotographic photosensitive member 1, the charging device 3, the developing device 5, the transferring device 6, the cleaning device 9, and the like, multiple components may be housed in a container and then integrally supported as a process cartridge. Further, the process cartridge may be detachably mountable to the main body of the electrophotographic apparatus such as a copier or a laser beam printer. For example, the electrophotographic photosensitive member 1 and at least one device selected from the group consisting of the charging device 3, the developing device 5, the transferring device 6, and the cleaning device 9 are integrally supported as a process cartridge 11. The process cartridge 11 is detachably mountable to the main body of the electrophotographic apparatus through the use of a guiding device 12 such as a rail of the main body of the electrophotographic apparatus.

EXAMPLES

Hereinafter, the present invention is described in more detail by way of Production Examples, Examples and Comparative Examples. Note that, the term "part(s)" in the examples refers to "part(s) by mass".

Further, each thickness in Examples and Comparative Examples was determined through the use of an eddy-current thickness meter (trade name: Fischerscope manufactured by Fischer Instruments K.K.) or in terms of specific gravity based on a mass per unit area.

Production Example 1

10 parts of silica particles (trade name: CARiACT G-3 having an average pore diameter of 3 nm manufactured by Fuji Silysia Chemical Ltd.) having a volume average particle diameter of 3 μm and a specific surface area of 600 $m^2/g$, 12 parts of Exemplified Compound (2-1), and 60 parts of ethyl acetate were subjected to a milling treatment with a ball mill for 24 hours. After the resultant was left to stand still for 24 hours, a product was collected by filtration. The product was washed with n-hexane on the filter and dried to obtain adsorbed particles.

According to the TG measurement of the adsorbed particles obtained in this case, the weight of the adsorbed particles decreased up to 350° C. higher than 210° C., which is the sublimation termination temperature of Exemplified Compound (2-1) alone, and hence it can be determined that Exemplified Compound (2-1) has been adsorbed to the silica particles. Further, the content of Exemplified Compound (2-1) was found from the amount of weight decrease to be 39% by mass in the adsorbed particles.

Production Example 2

5 parts of silica particles (trade name: CARiACT G-6 having an average pore diameter of 6 nm manufactured by Fuji Silysia Chemical Ltd.) having a volume average particle diameter of 3 μm and a specific surface area of 500 $m^2/g$, 3 parts of Exemplified Compound (2-1), and 30 parts of ethyl acetate were subjected to a milling treatment with a ball mill for 24 hours. After the resultant was left to stand still for 24 hours, a product was collected by filtration. The product was washed with n-hexane on the filter and dried to obtain 5.7 parts of adsorbed particles.

According to the TG measurement of the adsorbed particles obtained in this case, the weight of the adsorbed particles decreased up to 330° C. higher than 210° C., which is the sublimation termination temperature of Exemplified Compound (2-1) alone, and hence it can be determined that Exemplified Compound (2-1) has been adsorbed to the silica particles. Further, the content of Exemplified Compound (2-1) was found from the amount of weight decrease to be 18% by mass in the adsorbed particles.

Production Example 3

3 parts of silica particles (trade name: Porous Silica having a mesopore diameter of 7.1 nm and a pore diameter of 1.7 nm manufactured by Kusumoto Chemicals, Ltd.) having a volume average particle diameter of 4 μm and a specific surface area of 760 $m^2/g$, 4 parts of Exemplified Compound (2-1), and 20 parts of ethyl acetate were subjected to a milling treatment with a ball mill for 24 hours. After the resultant was left to stand still for 24 hours, a product was collected by filtration. The product was washed with n-hexane on the filter and dried to obtain 4.3 parts of adsorbed particles.

According to the TG measurement of the adsorbed particles obtained in this case, the weight of the adsorbed particles decreased up to 350° C. higher than 210° C., which is the sublimation termination temperature of Exemplified Compound (2-1) alone, and hence it can be determined that Exemplified Compound (2-1) has been adsorbed to the silica particles. Further, the content of Exemplified Compound (2-1) was found from the amount of weight decrease to be 31% by mass in the adsorbed particles.

Production Example 4

10 parts of silica particles (CARiACT G-3) having a volume average particle diameter of 3 μm and a specific surface area of 600 $m^2/g$, 6 parts of Exemplified Compound (2-5), and 60 parts of ethyl acetate were subjected to a milling treatment with a ball mill for 24 hours. After the resultant was left to stand still for 24 hours, a product was collected by filtration. The product was washed with n-hexane on the filter and dried to obtain adsorbed particles.

According to the TG measurement of the adsorbed particles obtained in this case, the weight of the adsorbed particles decreased up to 400° C. higher than 340° C., which is the sublimation termination temperature of Exemplified Compound (2-5) alone, and hence it can be determined that Exemplified Compound (2-5) has been adsorbed to the silica particles. Further, the content of Exemplified Compound (2-5) was found from the amount of weight decrease to be 33% by mass in the adsorbed particles.

Production Example 5

3 parts of silica particles (trade name: Porous Silica having a mesopore diameter of 7.1 nm and a pore diameter of 1.7 nm manufactured by Kusumoto Chemicals, Ltd.) having a volume average particle diameter of 4 μm and a specific surface area of 760 $m^2$/g, 2 parts of Exemplified Compound (2-5), and 20 parts of ethyl acetate were subjected to a milling treatment with a ball mill for 24 hours. After the resultant was left to stand still for 24 hours, a product was collected by filtration. The product was washed with n-hexane on the filter and dried to obtain 4.8 parts of adsorbed particles.

According to the TG measurement of the adsorbed particles obtained in this case, the weight of the adsorbed particles decreased up to 400° C. higher than 340° C., which is the sublimation termination temperature of Exemplified Compound (2-5) alone, and hence it can be determined that Exemplified Compound (2-5) has been adsorbed to the silica particles. Further, the content of Exemplified Compound (2-5) was found from the amount of weight decrease to be 37% by mass in the adsorbed particles.

Production Example 6

5 parts of silica particles (CARiACT G-3) having a volume average particle diameter of 3 μm and a specific surface area of 600 $m^2$/g, 1 part of Exemplified Compound (2-6), and 50 parts of ethyl acetate were subjected to a milling treatment with a ball mill for 24 hours. After the resultant was left to stand still for 24 hours, a product was collected by filtration. The product was washed with n-hexane on the filter and dried to obtain adsorbed particles.

According to the TG measurement of the adsorbed particles obtained in this case, the weight of the adsorbed particles decreased up to 400° C. higher than 340° C., which is the sublimation termination temperature of Exemplified Compound (2-6) alone, and hence it can be determined that Exemplified Compound (2-6) has been adsorbed to the silica particles. Further, the content of Exemplified Compound (2-6) was found from the amount of weight decrease to be 11% by mass in the adsorbed particles.

Production Example 7

2 parts of silica particles (CARiACT G-3) having a volume average particle diameter of 3 μm and a specific surface area of 600 $m^2$/g, 1 part of Exemplified Compound (1-5), and 20 parts of ethyl acetate were subjected to a milling treatment with a ball mill for 24 hours. After the resultant was left to stand still for 24 hours, a product was collected by filtration. The product was washed with n-hexane on the filter and dried to obtain 2.4 parts of adsorbed particles.

According to the TG measurement of the adsorbed particles obtained in this case, the weight of the adsorbed particles decreased up to 500° C. higher than 400° C., which is the sublimation termination temperature of Exemplified Compound (1-5) alone, and hence it can be determined that Exemplified Compound (1-5) has been adsorbed to the silica particles. Further, the content of Exemplified Compound (1-5) was found from the amount of weight decrease to be 22% by mass in the adsorbed particles.

Production Example 8

4 parts of silica particles (CARiACT G-3) having a volume average particle diameter of 3 μm and a specific surface area of 600 $m^2$/g, 12 parts of Exemplified Compound (1-2), and 20 parts of ethyl acetate were subjected to a milling treatment with a ball mill for 24 hours. After the resultant was left to stand still for 24 hours, a product was collected by filtration. The product was washed with n-hexane on the filter and dried to obtain 4.3 parts of adsorbed particles.

According to the TG measurement of the adsorbed particles obtained in this case, the weight of the adsorbed particles decreased up to 350° C. higher than 270° C., which is the sublimation termination temperature of Exemplified Compound (1-2) alone, and hence it can be determined that Exemplified Compound (1-2) has been adsorbed to the silica particles. Further, the content of Exemplified Compound (1-2) was found from the amount of weight decrease to be 40% by mass in the adsorbed particles.

Comparative Production Example 1

10 parts of silica particles (trade name: CARiACT G-10 having an average pore diameter of 10 nm manufactured by Fuji Silysia Chemical Ltd.) having a volume average particle diameter of 3 μm and a specific surface area of 300 $m^2$/g, 12 parts of Exemplified Compound (2-1), and 60 parts of ethyl acetate were subjected to a milling treatment with a ball mill for 24 hours. After the resultant was left to stand still for 24 hours, a product was collected by filtration. The product was washed with n-hexane on the filter and dried to obtain adsorbed particles.

According to the TG measurement of the adsorbed particles obtained in this case, the weight of the adsorbed particles decreased up to 300° C. higher than 210° C., which is the sublimation termination temperature of Exemplified Compound (2-1) alone, and hence it can be determined that Exemplified Compound (2-1) has been adsorbed to the silica particles. Further, the content of Exemplified Compound (2-1) was found from the amount of weight decrease to be 20% by mass in the adsorbed particles.

Comparative Production Example 2

4 parts of silica particles (CARiACT G-3) having a volume average particle diameter of 3 μm and a specific surface area of 600 $m^2$/g, 4 parts of 4,4'-bipyridyl, and 20 parts of ethyl acetate were subjected to a milling treatment with a ball mill for 24 hours. After the resultant was left to stand still for 24 hours, a product was collected by filtration. The product was washed with n-hexane on the filter and dried to obtain 4.7 parts of adsorbed particles.

According to the TG measurement of the adsorbed particles obtained in this case, the weight of the adsorbed particles decreased up to 330° C. higher than 200° C., which is the sublimation termination temperature of 4,4'-bipyridyl alone, and hence it can be determined that 4,4'-bipyridyl has been adsorbed to the silica particles. Further, the content of 4,4'-bipyridyl was found from the amount of weight decrease to be 37% by mass in the adsorbed particles.

Example 1

An aluminum cylinder having a diameter of 30 mm, a length of 357.5 mm, and a thickness of 1 mm was used as a support (conductive support).

Next, 50 parts of titanium oxide particles coated with tin oxide containing 10% antimony oxide (trade name: ECT-62 manufactured by Titan Kogyo, Ltd.), 25 parts of a resol type phenol resin (trade name: Phenolite J-325, solid content: 70% by mass, manufactured by Dainippon Ink & Chemicals, Inc.), 20 parts of methyl cellosolve, 5 parts of methanol, and 0.002 part of silicone oil (polydimethylsiloxane-polyoxyalkylene copolymer having an average molecular weight of 3000) were subjected to a dispersing treatment with a sand mill device using glass beads having a diameter of 0.8 mm for 2 hours to prepare a conductive-layer coating liquid. The conductive-layer coating liquid was applied onto a support by dip coating to form a coat, and the coat was dried at 140° C. for 30 minutes to form a conductive layer having a thickness of 15 μm.

Next, 2.5 parts of a nylon 6-66-610-12 quaternary nylon copolymer resin (trade name: CM8000 manufactured by Toray Industries, Inc.) and 7.5 parts of an N-methoxymethylated 6 nylon resin (trade name: Toresin EF-30T manufactured by Nagase ChemteX Corporation) were dissolved in a mixed solvent of 100 parts of methanol and 90 parts of butanol to prepare an undercoat-layer coating liquid. The undercoat-layer coating liquid was applied onto the conductive layer by dip coating to form a coat, and the coat was dried at 100° C. for 10 minutes to form an undercoat layer having a thickness of 0.6 μm.

Next, 11 parts of a hydroxygallium phthalocyanine crystal (charge generating substance) having strong peaks at Bragg angles)(2θ±0.2° of 7.4° and 28.2° in CuKα characteristic X-ray diffraction were prepared. 5 parts of a polyvinyl butyral resin (trade name: S-Lec BX-1 manufactured by Sekisui Kagaku Co., Ltd.) and 130 parts of cyclohexanone were mixed with the hydroxygallium phthalocyanine crystal, and 300 parts of glass beads having a diameter of 0.8 mm were added to the mixture. The resultant was subjected to a dispersing treatment at 1800 rpm for 2 hours while being cooled with cooling water at 18° C. After the dispersing treatment, the resultant was diluted by adding 300 parts of ethyl acetate and 160 parts of cyclohexanone to prepare a charge-generating-layer coating liquid. An average particle diameter (median) of the hydroxygallium phthalocyanine crystal in the charge-generating-layer coating liquid was measured through the use of a centrifugal particle size measuring apparatus (trade name: CAPA700 manufactured by Horiba Co., Ltd.) based on a liquid phase sedimentation method as a basic principle, and was 0.18 μm.

The charge-generating-layer coating liquid was applied onto the undercoat layer by dip coating to form a coat, and the coat was dried at 110° C. for 10 minutes to form a charge generating layer having a thickness of 0.17 μm.

Next, 5 parts of a compound (charge transporting substance) represented by the following structural formula (7), 5 parts of a compound (charge transporting substance) represented by the following structural formula (8), and 10 parts of a polycarbonate resin (trade name: Upilon Z400 manufactured by Mitsubishi Gas Chemical Company, Inc.) were dissolved in a mixed solvent of 70 parts of monochlorobenzene and 30 parts of dimethoxymethane to prepare a charge-transporting-layer coating liquid. The charge-transporting-layer coating liquid was applied onto the charge generating layer by dip coating to form a coat, and the coat was dried at 100° C. for 30 minutes to form a charge transporting layer having a thickness of 18 μm.

Structural Formual (7)

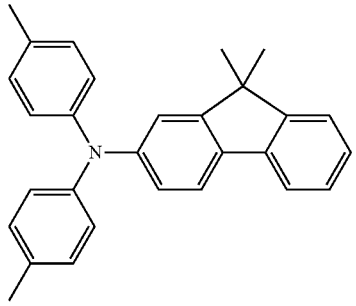

Structural Formula (8)

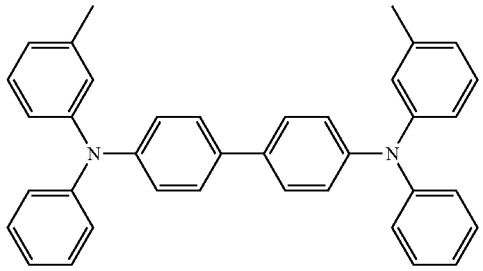

Next, 9 parts of a compound represented by the following structural formula (9) were dissolved in 10 parts of n-propanol and 10 parts of 1,1,2,2,3,3,4-heptafluorocyclopentane (trade name: ZEOROLA H manufactured by ZEON Corporation). 1 part of the adsorbed particles obtained in Production Example 1 and 20 parts of glass beads having a diameter of 0.8 mm were added to the resultant solution. The resultant was subjected to a dispersing treatment with a paint shaker for 2 hours to prepare a protective-layer coating liquid.

Structural Formula (9)

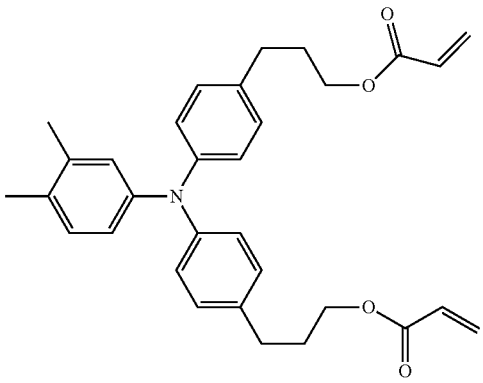

The protective-layer coating liquid was applied onto the charge transporting layer by dip coating to form a coat, and the coat was subjected to a heat treatment at 50° C. for 5 minutes. After that, the resultant coat was irradiated with an electron beam for 1.6 seconds under conditions of an acceleration voltage of 80 kV and an absorbed dose of $1.9\times10^4$ Gy in a nitrogen atmosphere. After that, the resultant was subjected to a heat treatment at 125° C. for 30 seconds in a nitrogen atmosphere. Note that the oxygen concentration in the nitrogen atmosphere from the start of the irradiation with an electron beam to the end of the heat treatment for 30 seconds was 17 ppm. Next, in the air, the resultant was subjected to a heat treatment at 110° C. for 20 minutes to form a protective layer having a thickness of 4.5 μm.

Thus, an electrophotographic photosensitive member including the support, the conductive layer, the undercoat layer, the charge generating layer, the charge transporting layer, and the protective layer, in which the protective layer served as a surface layer, was produced.

Example 2

An electrophotographic photosensitive member was produced in the same way as in Example 1 except that, in Example 1, 1 part of the adsorbed particles obtained in Production Example 1 was changed to 1 part of the adsorbed particles obtained in Production Example 2 to prepare a protective-layer coating liquid.

Example 3

An electrophotographic photosensitive member was produced in the same way as in Example 1 except that, in Example 1, 1 part of the adsorbed particles obtained in Production Example 1 was changed to 3 parts of the adsorbed particles obtained in Production Example 3 to prepare a protective-layer coating liquid.

Example 4

An electrophotographic photosensitive member was produced in the same way as in Example 1 except that, in Example 1, 1 part of the adsorbed particles obtained in Production Example 1 was changed to 1 part of the adsorbed particles obtained in Production Example 4 to prepare a protective-layer coating liquid.

Example 5

An electrophotographic photosensitive member was produced in the same way as in Example 1 except that, in Example 1, 1 part of the adsorbed particles obtained in Production Example 1 was changed to 0.3 part of the adsorbed particles obtained in Production Example 4 to prepare a protective-layer coating liquid.

Example 6

An electrophotographic photosensitive member was produced in the same way as in Example 1 except that, in Example 1, 1 part of the adsorbed particles obtained in Production Example 1 was changed to 3 parts of the adsorbed particles obtained in Production Example 5 to prepare a protective-layer coating liquid.

Example 7

An electrophotographic photosensitive member was produced in the same way as in Example 1 except that, in Example 1, 1 part of the adsorbed particles obtained in Production Example 1 was changed to 1 part of the adsorbed particles obtained in Production Example 6 to prepare a protective-layer coating liquid.

Example 8

An electrophotographic photosensitive member was produced in the same way as in Example 1 except that, in Example 1, 1 part of the adsorbed particles obtained in Production Example 1 was changed to 1 part of the adsorbed particles obtained in Production Example 7 to prepare a protective-layer coating liquid.

Example 9

An electrophotographic photosensitive member was produced in the same way as in Example 1 except that, in Example 1, 1 part of the adsorbed particles obtained in Production Example 1 was changed to 1 part of the adsorbed particles obtained in Production Example 8 to prepare a protective-layer coating liquid.

Comparative Example 1

An electrophotographic photosensitive member was produced in the same way as in Example 1 except that, in Example 1, a protective-layer coating liquid was prepared without adding adsorbed particles.

Comparative Example 2

An electrophotographic photosensitive member was produced in the same way as in Example 1 except that, in Example 1, 1 part of the adsorbed particles obtained in Production Example 1 was changed to 1 part of silica particles having a volume average particle diameter of 3 μm and a specific surface area of 600 $m^2/g$ (trade name: CARiACT G-3) to prepare a protective-layer coating liquid.

Comparative Example 3

An electrophotographic photosensitive member was produced in the same way as in Example 1 except that, in Example 1, 1 part of the adsorbed particles obtained in Production Example 1 was changed to 1 part of 1,1--dicyclohexyl-3-methyl-3-phenylurea to prepare a protective-layer coating liquid.

Comparative Example 4

An electrophotographic photosensitive member was produced in the same way as in Example 1 except that, in Example 1, 1 part of the adsorbed particles obtained in Production Example 1 was changed to 0.3 part of Exemplified Compound (1-5) to prepare a protective-layer coating liquid.

Comparative Example 5

An electrophotographic photosensitive member was produced in the same way as in Example 1 except that, in Example 1, 1 part of the adsorbed particles obtained in Production Example 1 was changed to 1 part of the particles obtained in Comparative Production Example 1 to prepare a protective-layer coating liquid.

Comparative Example 6

An electrophotographic photosensitive member was produced in the same way as in Example 1 except that, in Example 1, 1 part of the adsorbed particles obtained in Production Example 1 was changed to 1 part of the particles obtained in Comparative Production Example 2 to prepare a protective-layer coating liquid.

(Evaluation Methods)

Evaluation methods for the electrophotographic photosensitive members of Examples 1 to 9 and Comparative Examples 1 to 6 are as follows.

As the evaluation of durability of each electrophotographic photosensitive member, film properties of the surface layer were evaluated. As the evaluation of potential stability, a variation amount of a light portion potential of each electrophotographic photosensitive member was evaluated. As the evaluation of image deletion, repeating paper feeding use test of each electrophotographic photosensitive member was performed, and output image quality after the use test was evaluated. Further, as the evaluation of mechanical durability and electrical durability, the wear amount of the surface layer of each electrophotographic photosensitive member after the evaluation of the repeating paper feeding use test was evaluated.

(Evaluation of Film Properties of Surface Layer)

The universal hardness and the elastic deformation ratio of the surface of the surface layer of each electrophotographic photosensitive member of Examples 1 to 9 and Comparative Examples 1 to 6 were measured through the use of a hardness meter (trade name: H100VP-HCU manufactured by Fischer Instruments K.K.). A quadrangular pyramid diamond indenter with an angle between opposite faces at the tip thereof of 136° was pressed into the surface layer to be measured by applying a load to the indenter, and an indentation depth was electrically detected while applying the load. Further, measurement environment was set to 23° C./50% RH.

The universal hardness refers to physical property, and as the value of the universal hardness is larger, mechanical strength is larger. The universal hardness was determined based on a ratio obtained by dividing a test load (final load: 2 mN) by the surface area of an indentation (calculated from a geometric shape of the indenter) caused by the test load.

The elastic deformation ratio refers to physical property, and as the value of the elastic deformation ratio is larger, elasticity is larger. An indentation depth and a load were measured until the load became 0 by decreasing a test load (final load: 2 mN) to determine an elastic deformation ratio. It has been made clear that enhancing the two values obtained in this case enhances the mechanical durability of the surface layer with respect to wear, scars and the like.

(Variation Amount of Light Portion Potential)

As an evaluation apparatus, an electrophotographic copier GP-405 (manufactured by Canon Inc.) was used and restructured so that electric power was supplied to a corona charger from outside. Further, a drum cartridge of the GP-405 was restructured so that a corona charger was mounted on the drum cartridge, and as the corona charger, a charger for an electrophotographic copier GP-55 (manufactured by Canon Inc.) was mounted. The electrophotographic photosensitive member was mounted on the drum cartridge, and the resultant drum cartridge was mounted on the restructured GP-405. A variation amount of a light portion potential was evaluated as follows. Note that a heater (drum heater (cassette heater)) for an electrophotographic photosensitive member was kept OFF during evaluation.

The surface potential of the electrophotographic photosensitive member was measured under the condition that a developing unit was removed from a main body of the electrophotographic copier and a probe for measuring a potential (model 6000 B-8 manufactured by Trek Japan) was fixed at a development position. In this case, a transfer unit was designed so as not to come into contact with the electrophotographic photosensitive member, and paper was not fed.

Connection was made so that power source was supplied to the charger from an external power supply. As the power supply, a high-voltage power supply control system (Model 610C manufactured by Trek Japan) was used, and a discharge current amount was adjusted to 500 μA. Further, the conditions of a constant current control scorotron grid application voltage and an exposure light amount were set so that an initial dark portion potential (Vd) of the electrophotographic photosensitive member became about −650 (V) and an initial light portion potential (Vl) thereof became about −200 (V).

After the produced electrophotographic photosensitive member was mounted on the copier, an image having a printing ratio of 5% was used for feeding of 1000 A4-size sheets in the longitudinal direction under an environment of a temperature of 30° C. and a humidity of 80% RH. After the feeding of sheets, a value of the light portion potential (Vl) was measured, and a change from a value of the initial light portion potential was calculated as a potential variation ΔVl. Table 1 shows the results.

(Evaluation of Repeating Paper Feeding Use Test)

Then, the electrophotographic photosensitive member whose evaluation of potential variation was finished was mounted on the drum cartridge again. After that, an image having a printing ratio of 5% was used for feeding of additional 9000 A4-size sheets in the longitudinal direction (a total of 10000 sheets at the time of feeding), and then the supply of power to the copier was stopped and the copier was suspended for 72 hours. The supply of power to the copier was started again 72 hours later. A lattice image (4 lines, 40 spaces) and a character image (E-character image) in which an alphabet character "E" (font type: Times, font size: 6 points) was repeated were output onto an A4-size sheet in the longitudinal direction.

Similarly, further 40000 sheets (a total of 50000 sheets at the time of feeding) and 50000 sheets (a total of 100000 sheets at the time of feeding) were fed, and then the supply of power to the copier was stopped and the copier was suspended for 72 hours. The supply of power to the copier was started again 72 hours later, and the lattice image and the E-character image were output onto an A4-size sheet in the longitudinal direction.

The obtained images were visually observed and evaluated in accordance with the following evaluation ranks. In the present invention, it was determined that Ranks 5, 4, and 3 were levels at which the effects of the present invention were obtained, and of those, Rank 5 was an excellent level. On the other hand, it was determined that Ranks 1 and 2 were levels at which the effects of the present invention were not obtained. Table 1 shows evaluation results.

Rank 5: Image defects are not observed in the lattice image or the E-character image.

Rank 4: No image defects are observed in the E-character image although part of the lattice image is blurred.

Rank 3: Part of the lattice image is blurred, and part of the E-character image is reduced in density.

Rank 2: The lattice image has partially disappeared, and the entire surface of the E-character image is reduced in density.

Rank 1: The entire surface of the lattice image has disappeared, and the entire surface of the E-character image is reduced in density.

Further, the wear amount (μm) of the surface layer after a total of 100000 sheet paper feeding was evaluated. Table 1 shows evaluation results.

TABLE 1

| | Evaluation of film property of surface layer | | Change amount of light portion | Evaluation of repeating paper feeding use test | | | |
|---|---|---|---|---|---|---|---|
| | Universal hardness ($N/mm^2$) | Elastic deformation ratio (%) | potential after 1000-sheet paper feeding (V) | Image rank after 10000-sheet paper feeding | Image rank after 50000-sheet paper feeding | Image rank after 100000-sheet paper feeding | Wear amount after 100000-sheet paper feeding (μm) |
| Example 1 | 216 | 56 | 25 | 5 | 4 | 3 | 0.2 |
| Example 2 | 209 | 55 | 35 | 4 | 4 | 3 | 0.2 |
| Example 3 | 457 | 70 | 30 | 5 | 4 | 3 | 0.1 |
| Example 4 | 264 | 59 | 25 | 5 | 5 | 4 | 0.2 |
| Example 5 | 214 | 54 | 25 | 5 | 4 | 4 | 0.3 |
| Example 6 | 607 | 71 | 30 | 5 | 5 | 4 | 0.1 |
| Example 7 | 220 | 57 | 30 | 5 | 5 | 4 | 0.2 |
| Example 8 | 218 | 53 | 40 | 3 | 3 | 3 | 0.3 |
| Example 9 | 213 | 53 | 25 | 5 | 4 | 4 | 0.3 |
| Comparative Example 1 | 190 | 53 | 25 | 2 | 1 | 1 | 0.5 |
| Comparative Example 2 | 155 | 55 | 180 | 1 | — | — | End of evaluation because of image defects after 10000-sheet paper feeding |
| Comparative Example 3 | 175 | 47 | 90 | 2 | 1 | — | End of evaluation because of image defects after 50000-sheet paper feeding |
| Comparative Example 4 | 190 | 50 | 75 | 2 | 2 | 1 | 0.6 |
| Comparative Example 5 | 200 | 55 | 110 | 3 | 1 | — | End of evaluation because of image defects after 50000-sheet paper feeding |
| Comparative Example 6 | 196 | 54 | 85 | 2 | 1 | — | End of evaluation because of image defects after 50000-sheet paper feeding |

Example 10

An electrophotographic photosensitive member in which a charge transporting layer served as a surface layer was produced in the same way as in Example 1 except that a charge-transport-layer coating liquid was prepared as follows and a protective layer was not provided.

0.6 parts of the adsorbed particles obtained in Production Example 4 and 20 parts of glass beads having a diameter of 0.8 mm were added to 12 parts of the charge-transporting-layer coating liquid prepared in Example 1, and the mixture was subjected to a dispersing treatment with a paint shaker for 2 hours to prepare a charge-transporting-layer coating liquid.

Comparative Example 7

An electrophotographic photosensitive member was produced in the same way as in Example 1 except that a protective layer was not provided.

(Evaluation Methods)

Evaluation methods for the electrophotographic photosensitive members of Example 10 and Comparative Example 7 are as follows. The evaluations of durability and potential stability of each electrophotographic photosensitive member were performed. The respective evaluation methods are as described above. As the evaluation of image deletion, 50000-sheet repeating paper feeding use test was performed as described below, and image quality after the use test was evaluated. Further, as the evaluation of mechanical durability and electrical durability, the wear amount of the charge transporting layer serving as the surface layer after the evaluation of the repeating paper feeding use test was evaluated. Table 2 shows the results.

(Evaluation of 50000-sheet Repeating Paper Feeding Use Test)

As described above, the electrophotographic photosensitive member whose evaluation of potential variation was finished was mounted on the drum cartridge again. After that, an image having a printing ratio of 5% was used for feeding of additional 9000 A4-size sheets in the longitudinal direction (a total of 10000 sheets at the time of feeding), and then the supply of power to the copier was stopped and the copier was suspended for 72 hours. The supply of power to the copier was started again 72 hours later, and the lattice image and the E-character image similar to the foregoing were output onto an A4-size sheet in the longitudinal direction.

Similarly, further 40000 sheets (a total of 50000 sheets at the time of feeding) were fed, and then the supply of power to the copier was stopped and the copier was suspended for 72 hours. The supply of power to the copier was started again 72 hours later, and the lattice image and the E-character image were output onto an A4-size sheet in the longitudinal direction.

The obtained images were visually observed and evaluated as Ranks 1 to 5 in accordance with the above-mentioned evaluation ranks. The evaluation criteria are as described above. Table 2 shows the results.

Further, the wear amount (μm) of the charge transporting layer after a total of 50000 sheet paper feeding was evaluated. Table 2 shows the evaluation results.

TABLE 2

| | Evaluation of film property of surface layer | | Change amount of light portion | Evaluation of repeating paper feeding use test | | |
|---|---|---|---|---|---|---|
| | | | | Image rank | Image rank | Wear amount |
| | Universal hardness ($N/mm^2$) | Elastic deformation ratio (%) | potential after 1000-sheet paper feeding (V) | after 10000-sheet paper feeding | after 50000-sheet paper feeding | after 50000-sheet paper feeding (μm) |
| Example 10 | 150 | 57 | 25 | 5 | 5 | 6 |
| Comparative Example 7 | 141 | 54 | 20 | 2 | 1 | 10 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-227217, filed Oct. 12, 2012, and Japanese Patent Application No. 2013-188430, filed Sep. 11, 2013, which are hereby incorporated by reference herein in their entirety.

What is claimed is:

1. An electrophotographic photosensitive member comprising:

an electrically conductive support; and a photosensitive layer formed on the support;

wherein a surface layer of the electrophotographic photosensitive member comprises particles which comprise:

silica particles; and a compound-A adsorbed to each of the silica particles, the silica particles have a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound and a urea compound, and the compound-A has a molecular weight of 150 or more and 550 or less.

2. The electrophotographic photosensitive member according to claim 1, wherein the compound-A is a tertiary amine compound having a molecular weight of 150 or more and 550 or less.

3. The electrophotographic photosensitive member according to claim 1, wherein the tertiary amine compound is a compound represented by the following structural formula (1):

Structural Formula (1)

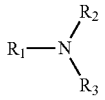

in the structural formula (1), $R_1$ to $R_3$ each independently represent a substituted or unsubstituted alkyl group, a substituted or unsubstituted aryl group, or a monovalent group represented by the following structural formula (2) or (3):

Structural Formula (2)

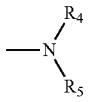

Structural Formula (3)

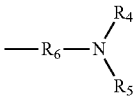

in the structural formulae (2) and (3), $R_4$ and $R_5$ each independently represent a substituted or unsubstituted alkyl group or a substituted or unsubstituted aryl group, and $R_6$ represents a substituted or unsubstituted alkylene group, a substituted or unsubstituted alkylene group, or a divalent group produced by combining the substituted or substituted alkylene group and the substituted or unsubstituted arylene group.

4. The electrophotographic photosensitive member according to claim 1, wherein the compound-A is a urea compound having a molecular weight of 150 or more and 550 or less.

5. The electrophotographic photosensitive member according to claim 1, wherein the urea compound is a compound represented by the following structural formula (4):

Structural Formula (4)

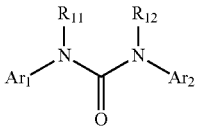

in the structural formula (4), $R_{11}$ and $R_{12}$ each independently represent an alkyl group, and $Ar_1$ and $Ar_2$ each independently represent a substituted or unsubstituted aryl group.

6. The electrophotographic photosensitive member according to claim 1, wherein the urea compound is a compound represented by the following structural formula (5):

Structural Formula (5)

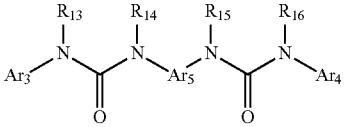

in the structural formula (5), $R_{13}$ to $R_{16}$ each independently represent an alkyl group, $Ar_3$ and $Ar_4$ each independently represent a substituted or unsubstituted aryl group, and $Ar_5$ represents a substituted or unsubstituted arylene group.

7. The electrophotographic photosensitive member according to claim 6, wherein the $Ar_3$ and the $Ar_4$ each represent a substituted or unsubstituted phenyl group, the $Ar_5$ represents a phenylene group, and the $R_{13}$ to the $R_{16}$ each represent a methyl group.

8. The electrophotographic photosensitive member according to claim 1, wherein the silica particles have a specific surface area of 550 $m^2/g$ or more and 1000 $m^2/g$ or less.

9. The electrophotographic photosensitive member according to claim 1, wherein the silica particles have pores and an average pore diameter of 5 nm or less.

10. The electrophotographic photosensitive member according to claim 1, wherein the compound-A is adsorbed to each of the silica particles in an amount of 10% by mass or more and 50% by mass or less based on 100 parts by mass of the particles which include the silica particles and the compound-A adsorbed to each of the silica particles.

11. A process cartridge detachably mountable to a main body of an electrophotographic apparatus, wherein the process cartridge integrally supports: the electrophotographic photosensitive member according to claim 1; and at least one device selected from the group consisting of a charging device, a developing device, a transferring device, and a cleaning device.

12. An electrophotographic apparatus, comprising: the electrophotographic photosensitive member according to claim 1; a charging device; an image exposing device; a developing device; and a transferring device.

13. A particle comprising:

a silica particle; and a compound-A adsorbed to the silica particle, wherein the silica particle has a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound represented by the following formula (1) and a urea compound, Structural Formula (1)

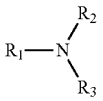

in the structural formula (1), $R_1$ to $R_3$ each independently represent a substituted or unsubstituted alkyl group, a substituted or unsubstituted aryl group, or a monovalent group represented by the following structural formula (2) or (3):

Structural Formula (2)

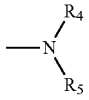

Structural Formula (3)

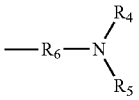

in the structural formulae (2) and (3), $R_4$ and $R_5$ each independently represent a substituted or unsbustituted alkyl group or a substituted or unsubstituted aryl group, and $R_6$ represents a substituted or unsusbstituted alkylene group, a substituted or unssubstituted arylene group, or a divalent group produced by combining the substituted or unsubstituted alkylene group and the substituted or unsubstituted arylene group, wherein the substituted alkyl group has an alkoxy group, a halogen group, or an aryl group as a substitutent, and substituted aryl group has an alkyl group, an alkoxy group, an alkylamino group, or a halogen group as a substitutent, and the compound-A has a molecular weight of 150 or more and 550 or less.

14. A production method for an electrophotographic photosensitive member comprising an electrically conductive support and a photosensitive layer formed on the support, the production method comprising:

obtaining particles which include silica particles and a compound-A adsorbed to each of the silica particles by mixing the silica particles and the compound-A in asolvent followed by milling;

preparing a surface-layer coating liquid containing the particles which include the silica particles and the compound-A adsorbed to each of the silica particles;

forming a coat of the surface-layer coating liquid; and forming a surface layer of the electrophotographic photosensitive member by drying the coat, wherein the silica particles have a volume average particle diameter of 0.1 μm or more and 4 μm or less, and a specific surface area of 400 $m^2/g$ or more and 1000 $m^2/g$ or less, the compound-A is at least one selected from the group consisting of a tertiary amine compound and a urea compound, and the compound-A has a molecular weight of 150 or more and 550 or less.

15. The electrophotographic photosensitive member according to claim 3, wherein the substituted alkyl group has an alkoxy group, a halogen group, or an aryl group as a substitutent, and the substituted aryl group has an alkyl group, an alkoxy group, an alkylamino group, or a halogen group as a substituent.

* * * * *